US005964235A

United States Patent [19]

Wang

[11] Patent Number: 5,964,235

[45] Date of Patent: Oct. 12, 1999

[54] UMBRELLA WITH AN IMPROVED RUNNER FASTENER

[76] Inventor: Max Wang, No. 19, Ta-Yuan-Shih-San St., Tai-Ping City, Taichung Hsien, Taiwan

[21] Appl. No.: 09/038,454

[22] Filed: Mar. 11, 1998

[51] Int. Cl.[6] ..... A45B 25/08

[52] U.S. Cl. ..... 135/28; 135/39

[58] Field of Search ..... 135/28, 37–41, 135/42

[56] References Cited

U.S. PATENT DOCUMENTS 5,253,666 10/1993 Huang ..... 135/39 X

*Primary Examiner*—Robert Canfield
*Attorney, Agent, or Firm*—Ladas & Parry

[57] ABSTRACT

An umbrella includes an elongate handle, a canopy mounted on an upper end of the handle, and a rib assembly for supporting the canopy. A tubular runner is slidably sleeved on the handle and is movable between upper and lower positions for spreading and collapsing the canopy, respectively. A stretcher assembly is disposed to stretch or retract the rib assembly. A resilient tongue member is secured on the upper end of the handle, and has a distal hook end which is biased away from the handle in a lateral and transverse direction. An annular inner wall of the runner defines a guideway to receive the tongue member and retain the hook end during upward movement of the runner to the upper position.

4 Claims, 6 Drawing Sheets

UMBRELLA WITH AN IMPROVED RUNNER FASTENER

BACKGROUND OF THE INVENTION

1. Field of the Invention

This invention relates to an umbrella, more particularly to an umbrella with a resilient hooked tongue mounted on a handle and a slidable runner for receiving retainingly the tongue at a stretched position of the umbrella.

2. Description of the Related Art

The conventional umbrella is known to have an elongate handle with an upper hole in which a spring-loaded stop is provided. A runner is slidably sleeved on the handle to connect pivotally with a stretcher assembly to support a rib assembly which is mounted on an upper end of the handle. The runner is movable along the handle between an upper position for stretching the rib assembly and a lower position for collapsing the same. At the upper position, the runner is retainingly supported by the stop.

In view of the fact that the handle of the conventional umbrella should be made hollow to receive the spring-loaded stop, it was not contemplated to provide a solid structure of the handle. Due to this inherent limitation of the handle, which is a primary part of the umbrella in terms of the strength, it is quite difficult to further improve the rigidity of the handle, and hence the durability of the umbrella.

SUMMARY OF THE INVENTION

The object of the present invention is to provide an umbrella which can overcome the aforementioned problems commonly associated with the prior art.

According to this invention, an umbrella includes an elongate handle, a canopy which is mounted on an upper end of the handle, and a rib assembly for supporting the canopy. A tubular runner is slidably sleeved on the handle and is movable between upper and lower positions for spreading and collapsing the canopy, respectively. A stretcher assembly is disposed to interconnect the rib assembly and the runner to stretch or retract the rib assembly when the runner is moved to the upper or lower positions, respectively. A resilient tongue member is secured on the upper end of the handle, and has a distal hook end which is biased away from the handle in a lateral and transverse direction. An annular inner wall of the runner defines a guideway with a first distance from the handle to receive the tongue member. The guideway has an engaging end portion which is formed with a constricted passage with a diameter shorter than the first distance so as to retain the hook end when upward movement of runner to the upper position by manual force thrusts the hook end against biasing action towards the handle. Preferably, the runner further has a slot which communicates with the constricted passage for retaining the hook end.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
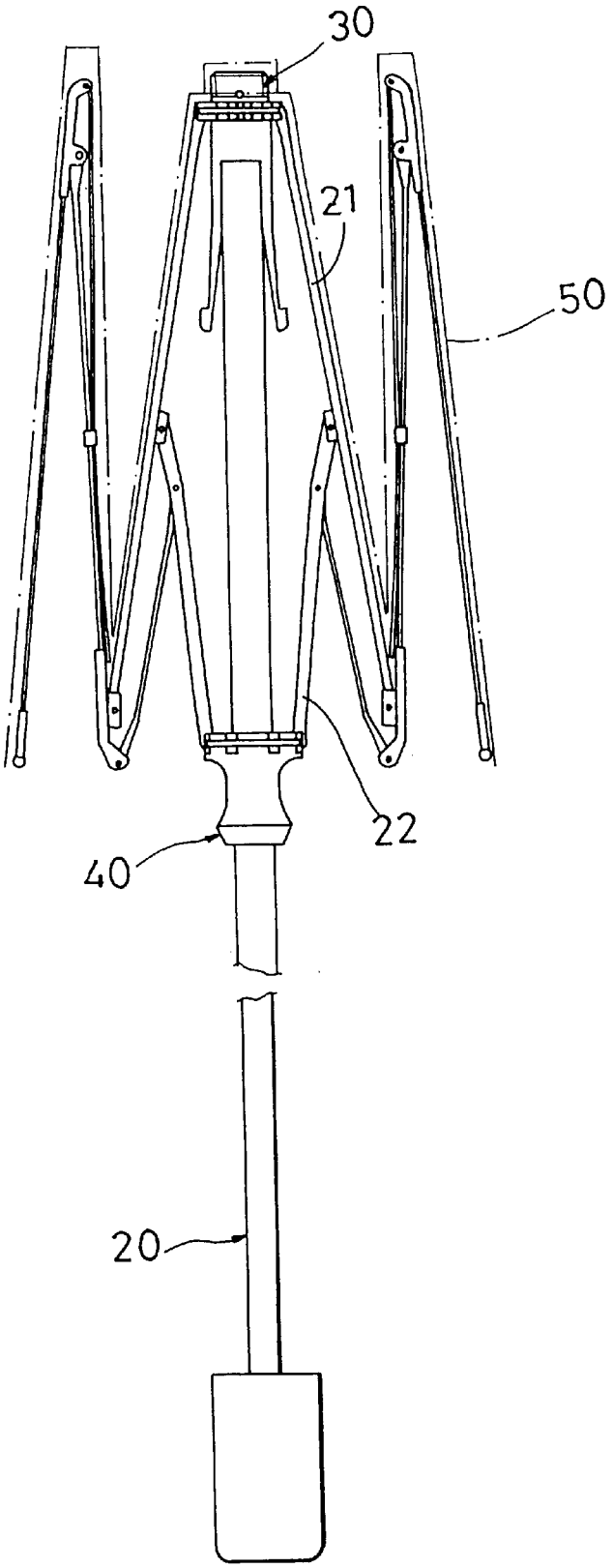
FIG. 1 is a schematic view of a preferred embodiment of an umbrella according to this invention in a collapsed position.

Referring to FIG. 1, a preferred embodiment of an umbrella according to the present invention is shown to comprise an elongate handle 20 which has a hub 30 secured on an upper end thereof, a canopy 50 which is mounted on the upper end, and a rib assembly 21 which is connected pivotally to an upper portion of the hub 30 and which is disposed at an underside of the canopy 50 to support the canopy 50 in a spread-out position and in a collapsed position. A tubular runner 40 is slidably sleeved on the handle 20. The runner 40 is movable between an upper position corresponding to the spread-out position and a lower position which is within a middle portion of the handle 20 and which corresponds to the collapsed position. A stretcher assembly 22 is disposed to interconnect pivotally the rib assembly 21 and the runner 40 so as to stretch or retract the rib assembly 21 to put the canopy 50 in the spread-out position or the collapsed position when the runner 40 is moved to the upper position or the collapsed position, respectively.

Figure 2:
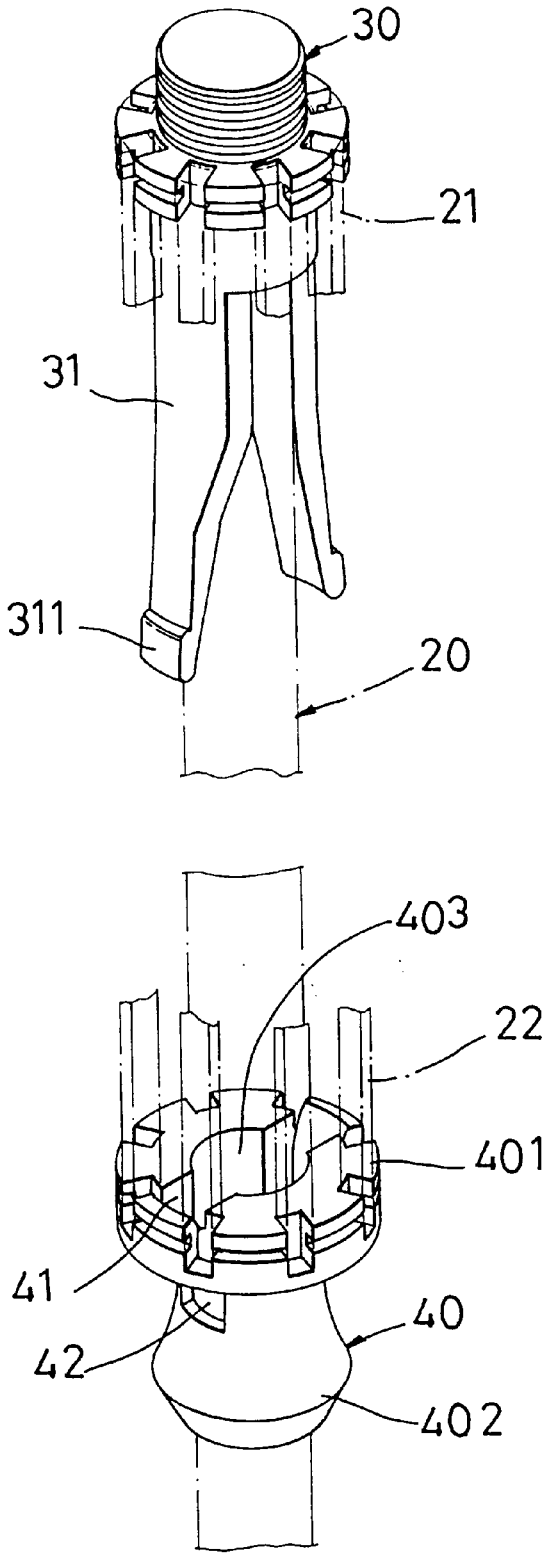
FIG. 2 is an exploded view of the runner fastener of the preferred embodiment.
Figure 3:
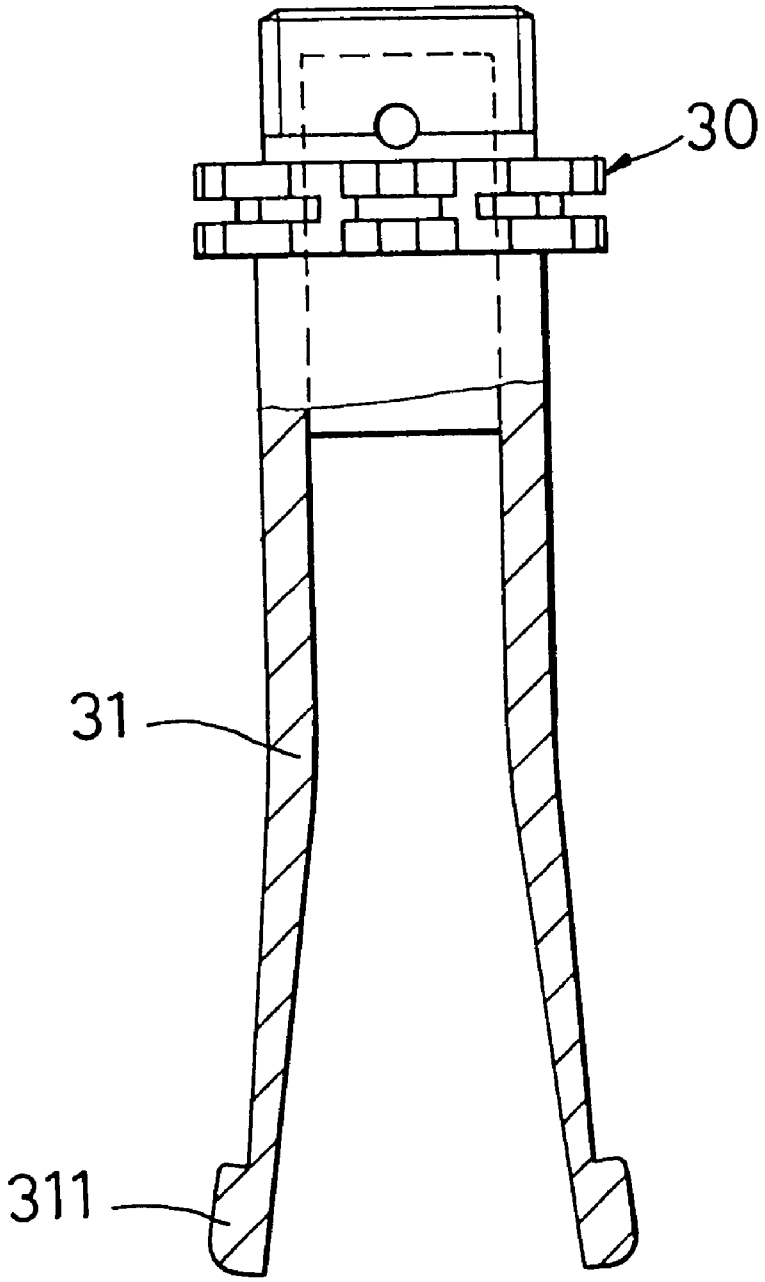
FIGS. 3 and 4 are sectional views showing a hub and a runner of the runner fastener.

Referring to FIGS. 2 and 3, the hub 30 is formed integrally with a pair of opposing resilient tongue members 31 which extend downwardly. Each tongue member 31 has a proximal end and a distal hook end 311 which is biased away from the handle 20 in a lateral and transverse direction.

Figure 4:
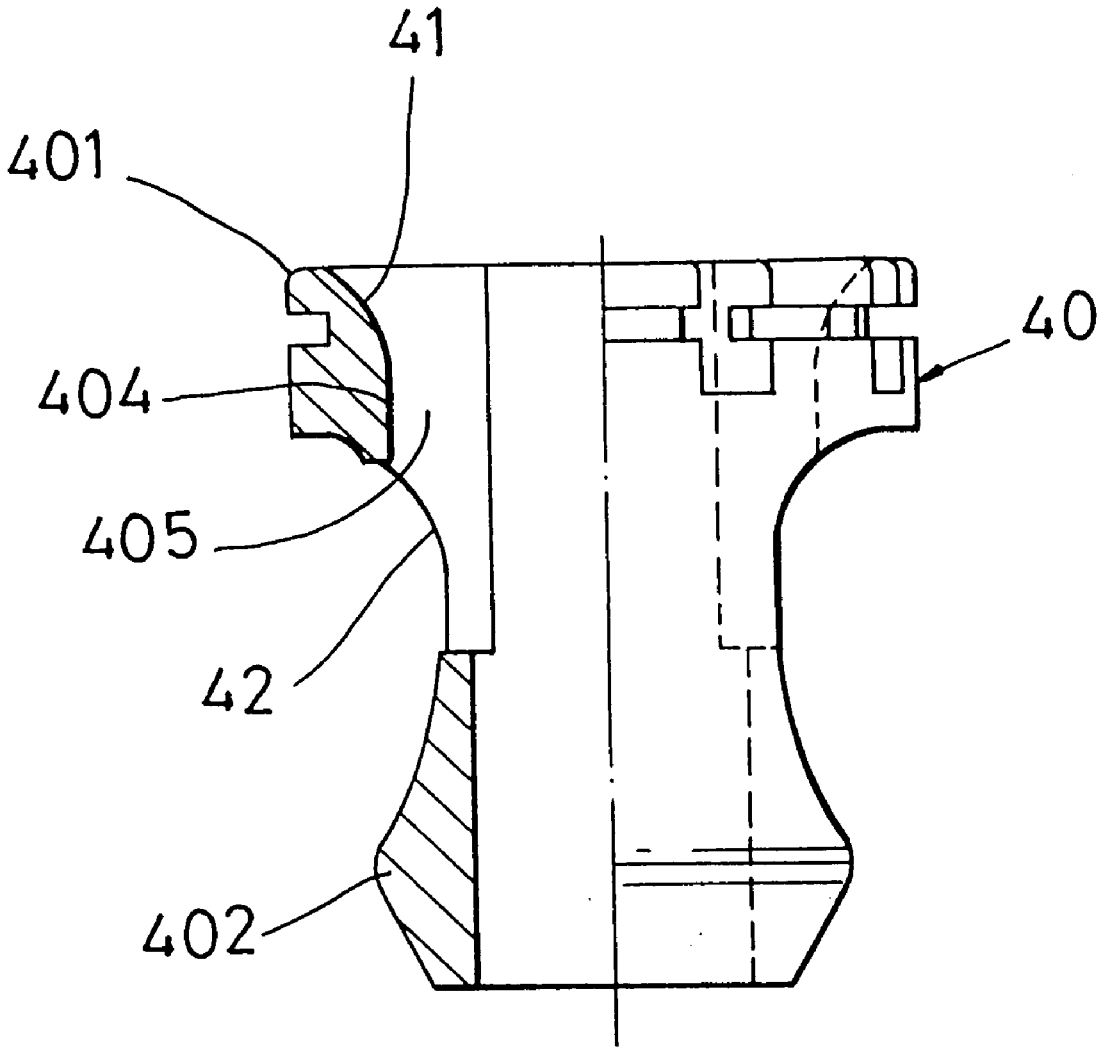

With reference to FIGS. 2 and 4, the runner 40 has an annular inner wall 403 which is to be in slidable contact with an outer circumference of the handle 20. The inner wall 403 defines a pair of opposing guideways 41 which extend from an upper edge 401 towards a lower edge 402 of the runner 40. Each guideway 41 is disposed to be radially spaced apart from the outer circumference of the handle 20 with a first distance to receive the corresponding tongue member 31, and includes an engaging end portion 404 which is distal to the upper edge 401 and which forms with the outer circumference of the handle 20 a constricted passage 405 with a diameter that is shorter than the first distance. In addition, the guideway 41 is inclined toward the engaging end portion 404 so as to facilitate passage of the corresponding tongue member 31. Preferably, the runner 40 further has a slot 42 which is formed to extend radially and inwardly toward the outer circumference of the handle 20 and which communicates with the constricted passage 405.

Figure 5:
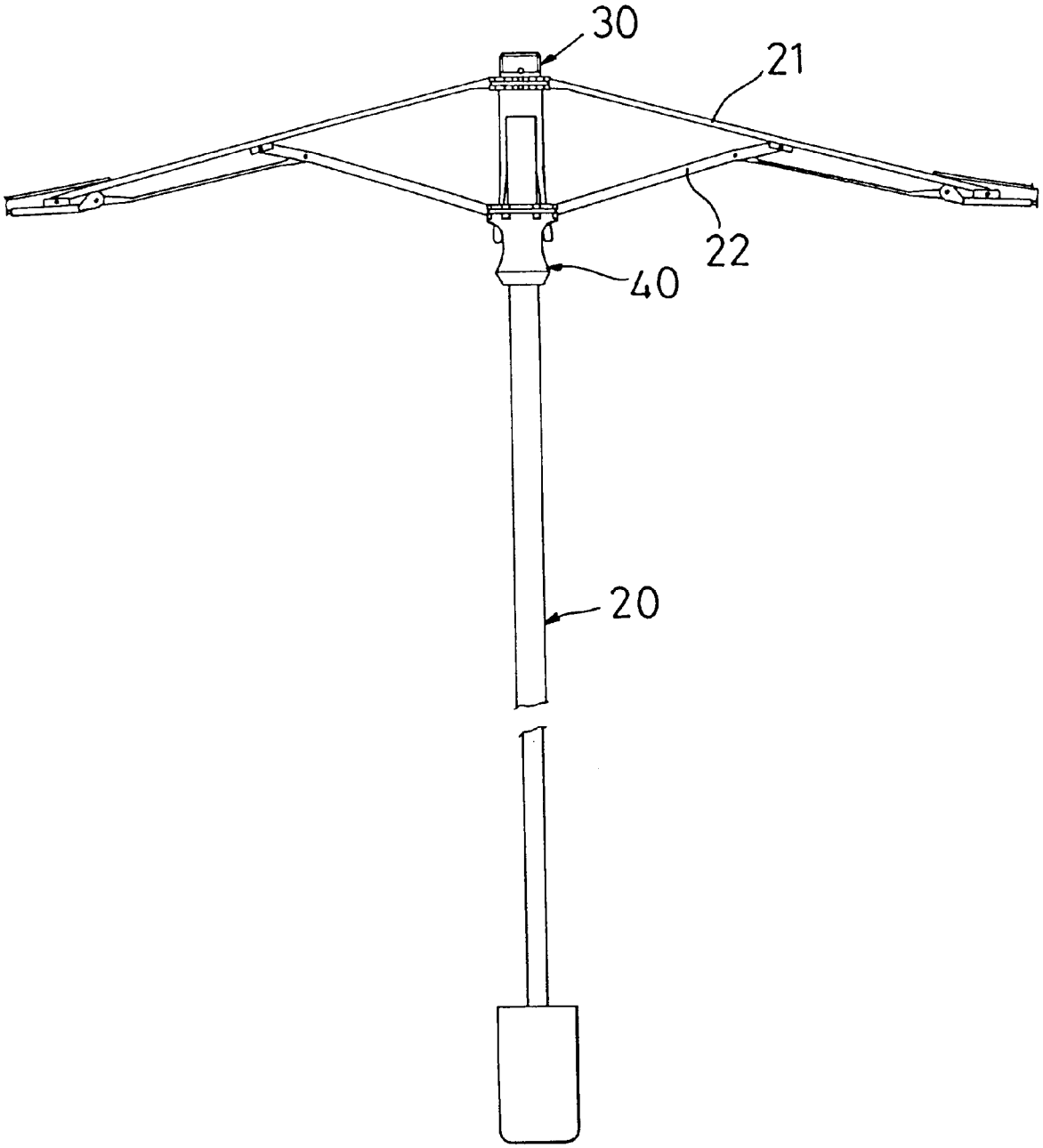
FIG. 5 is a schematic view of the umbrella in a stretched position.
Figure 6:
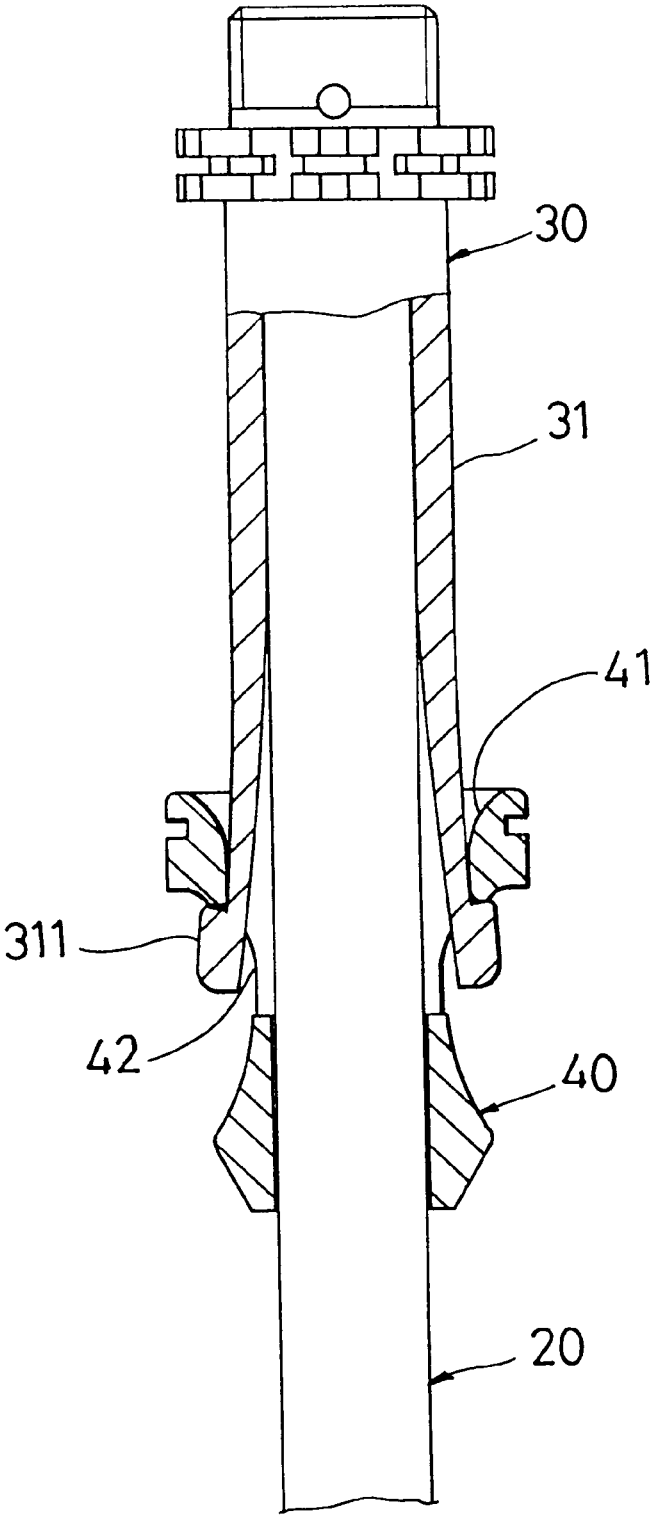
FIG. 6 is a sectional view showing the engagement of the runner fastener.

With reference to FIGS. 5 and 6, when the runner 40 is moved upwardly by manual force to the upper position for spreading the canopy 50, the guideways 41 engages the hook end 311 of the tongue members 31 from the upper edge 401, and the engaging end portion 404 retains the hook ends 311, thereby thrusting the hook ends 311 against the biasing action toward the handle 20. Sequentially, the hook ends 311 project out of the slots 42 by means of the resilient force of the resilient tongue members 31 and are retained therein. Compared to the conventional umbrella, there is no need to provide a spring-loaded stop and to form a hole according to the umbrella of the present invention, thereby decreasing assembly cost and time. In addition, the handle 20 can maintain its strength because there is no hole formed in the handle 20.

When it is desired to collapse the umbrella, the hook ends 311 are pressed inwardly so as to disengage with the slots 42.

The runner 40 moves downward to the lower position due to its weight. Note that the user usually grasps the runner 40 during the collapsing operation, thereby preventing injury to the user.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An umbrella comprising;

an elongate handle having an upper end, a lower end and a middle portion therebetween;

a canopy mounted on said upper end;

a rib assembly disposed at an underside of said canopy to secure the mounting of said canopy on said upper end and to support said canopy in a spread-out position and in a collapsed position;

a tubular runner slidably sleeved on said handle and having an upper edge proximate to said upper end and a lower edge, said runner being movable between an upper position corresponding to said spread-out position and a lower position which is within said middle portion and corresponds to said collapsed position;

a stretcher assembly disposed to interconnect said rib assembly and said runner so as to stretch or retract said rib assembly to put said canopy in said spread-out position or said collapsed position when said runner is moved to said upper position or said lower position respectively; and a resilient tongue member disposed on said handle and having a proximate end fixed to said upper end and a distal hook end extending toward said middle portion and into said upper position, said hook end being biased away from said handle in a lateral and transverse direction, wherein said runner includes an annular inner wall which is to be in slidable contact with an outer circumference of said handle, said inner wall defining a guideway which extends from said upper edge towards said lower edge, and which is disposed to be radially spaced apart from said outer circumference with such a first distance to receive said tongue member, said guideway including an engaging end portion which is distal to said upper edge and which forms with said outer circumference a constricted passage with a diameter shorter than said first distance so as to retain said hook end when upward movement of said runner to said upper position by manual force thrusts said hook end against its biasing action into said constricted passage.

2. The umbrella as claimed in claim 1, wherein said guideway is inclined toward said engaging end portion.

3. The umbrella as claimed in claim 2, wherein said runner includes a slot which extends radially and inwardly toward said outer circumference and which communicates with said constricted passage at such a position that said hook end will be biased to protrude and be retained in said slot once it is forced into said constricted passage.

4. The umbrella as claimed in claim 1, further comprising a hub secured to said upper end of said handle to be connected pivotally to said rib assembly, said tongue member being formed integrally with and extending downward from said hub.

* * * * *